US005111025A

United States Patent [19]

Barma et al.

[11] Patent Number: 5,111,025

[45] Date of Patent: May 5, 1992

[54] SEAT HEATER

[75] Inventors: Pradeep Barma, Fremont; Corey J. McMills, Los Altos, both of Calif.

[73] Assignee: Raychem Corporation, Menlo Park, Calif.

[21] Appl. No.: 634,935

[22] Filed: Dec. 27, 1990

Related U.S. Application Data

[63] Continuation of Ser. No. 477,689, Feb. 9, 1990, abandoned.

[51] Int. Cl.[5] ..... H05B 3/36

[52] U.S. Cl. ..... 219/217; 219/528; 219/549

[58] Field of Search ..... 219/217, 528, 529, 549, 219/552, 553

[56] References Cited

U.S. PATENT DOCUMENTS

| | | | |
|---|---|---|---|
| 2,340,097 | 1/1944 | Woodman | 219/529 |
| 3,096,428 | 7/1963 | Dubliner | 219/528 |
| 3,781,526 | 12/1973 | Damron | 219/528 |
| 3,793,716 | 2/1974 | Smith-Johannsen | 29/611 |
| 4,055,615 | 10/1977 | Ikeda | 264/105 |
| 4,204,316 | 5/1980 | Hummel | 29/61 |
| 4,369,356 | 1/1983 | Tsurutani | 219/549 |
| 4,775,501 | 10/1988 | Rosenzweig | 264/27 |
| 4,853,165 | 8/1989 | Rosenzweig | 264/27 |
| 4,938,820 | 7/1990 | McMills | 156/83 |
| 4,952,776 | 8/1990 | Huguet | 219/217 |

FOREIGN PATENT DOCUMENTS

| | | | |
|---|---|---|---|
| 2006165 | 2/1970 | Fed. Rep. of Germany . | |
| 2530937 | 1/1977 | Fed. Rep. of Germany | 219/219 |
| 272753A1 | 10/1989 | German Democratic Rep. . | |
| 272754A1 | 10/1989 | German Democratic Rep. . | |
| 1-164620 | 6/1989 | Japan . | |
| WO85/01482 | 4/1985 | PCT Int'l Appl. . | |
| WO88/06517 | 9/1988 | PCT Int'l Appl. . | |
| 2065430A | 6/1981 | United Kingdom . | |

OTHER PUBLICATIONS

"Freeze-proof lines with electric tape", Power, vol. 91, p. 55, Oct., 1973 (New York).

*Primary Examiner*—Teresa J. Walberg
*Attorney, Agent, or Firm*—Marguerite E. Gerstner; Timothy H. P. Richardson; Herbert G. Burkard

[57] ABSTRACT

A flexible heater in which a heating element in the form of a tape is wrapped around a support member in the form of a flat sheet. The tape, which exhibits flexibility and toughness, has a composition composed of conductive sintered ultrahigh molecular weight polyethylene. The flexible heater is suitable for heating an upholstered seat, e.g. an automobile seat.

14 Claims, 3 Drawing Sheets

SEAT HEATER

CROSS-REFERENCE TO RELATED APPLICATIONS

This application is a continuation of copending, commonly assigned application Ser. No. 07/477,689, filed Feb. 9, 1990 now abandoned, the disclosure of which is incorporated herein by reference.

BACKGROUND OF THE INVENTION

1. Field of the Invention

This invention relates to flexible heaters which are suitable for heating seats in automobiles and other vehicles.

2. Introduction to the Invention

In cold climates, it is desirable to heat not only the air in the passenger compartment of an automobile or similar vehicle, but also the seats in which people are sitting. Until now, car seats have been heated, if at all, by means of series-connected heating wires. The known heaters, however, suffer from a variety of problems. These include failure due to intermittent flexing of the wires as the seat is occupied, the requirement for high power output to provide a minimum comfort level, the slow rate of heating due to the low ratio of heater coverage to seat area, and the partial penetration of the wires through the leather or fabric covering the seat leading to a "show through effect".

Attempts to correct some of these problems have been made. For example, Damron U.S. Pat. No. 3,781,526 discloses a sheet heater suitable for heating a stadium seat. The heater comprises an electrically conductive paper; interdigitated electrodes are positioned at the edges of the paper. Japanese Patent Publication No. 1-164,620/1989 (Toyoda Boshoku KK; Tokai Senko KK) discloses a durable, flexible sheet heater for heating vehicle seats. The heater comprises a fabric layer on which a conductive metal layer is electroplated. The resulting heater is attached to the seat cushion. Neither solution has solved all the problems.

SUMMARY OF THE INVENTION

We have now found that a thin, flexible heating element in the form of a tape can be used to provide efficient, reliable heat. Thus in a first aspect, the invention provides a flexible heater which comprises (1) a support member which is in the form of a flat sheet; and (2) a heating element which is in the form of a tape which has a ratio of external surface area to polymer volume of at least 20 $inch^{-1}$, which is wrapped around the support member, and which comprises (a) a resistive element which is composed of (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

In a second aspect, the invention provides a shaped article, e.g. a seat back, which comprises (1) a resilient foam of a polymeric material, and (2) at least partially embedded in the foam, a heating element which is in the form of a tape which has a ratio of external surface area to polymer volume of at least 20 $inch^{-1}$ and which comprises (a) a resistive element which is composed of (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

In a third aspect, the invention provides an upholstered seat which comprises a resilient seat member which is covered by a seat cover, a resilient back member which is covered by a back cover, and a flexible heater which lies between the resilient back member and the back cover, or between the resilient seat member and the seat cover, or both, the flexible heater comprising (1) a support member which is in the form of a flat sheet; and (2) a heating element which is in the form of a tape which has a ratio of external surface area to polymer volume of at least 20 $inch^{-1}$, which is wrapped around the support member, and which comprises (a) a resistive element which is composed of (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

BRIEF DESCRIPTION OF THE DRAWING

The invention is illustrated by the following drawing.

DETAILED DESCRIPTION OF THE INVENTION

Figure 1:
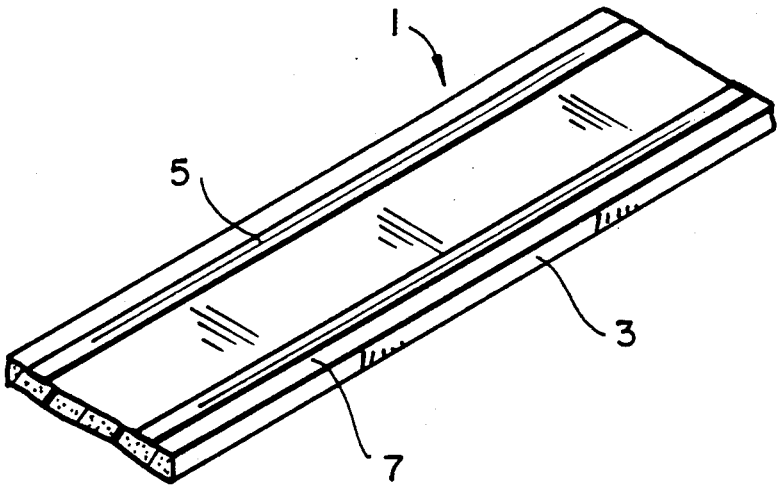
FIG. 1 is a perspective view of a heating element which provides one component of the invention.

In this invention, the heating element is in the form of a tape which comprises a resistive element and elongate electrodes. The resistive element comprises a conductive polymer composition composed of a polymer matrix, and, dispersed, or otherwise distributed in the matrix, a particulate conductive filler. The polymeric component is preferably a crystalline organic polymer or blend comprising at least one crystalline organic polymer. Particularly preferred is ultrahigh molecular weight polyethylene (UHMWPE), a polymer which has a molecular weight greater than about 1.5 million, particularly greater than about 3 million, and especially as high as about 4 to 6 million, and which maintains a relatively high viscosity above its melting point. The conductive filler may be carbon black, graphite, metal, metal oxide, or a combination of these, or a particulate conductive filler which itself comprises an organic polymer with a particulate conductive filler dispersed in it. Such composite particulate conductive polymers are disclosed in copending, commonly assigned U.S. application Ser. No. 07/75,929, filed Jul. 21, 1987 (Barma et al), the disclosure of which is incorporated herein by reference. The conductive polymer element may also comprise antioxidants, inert fillers, chemical crosslinking agents (often referred to as prorads), stabilizers, dispersing agents, or other components. Dispersion of the conductive filler and other components is preferably achieved by dry-blending of powders. The resulting mixture can then be shaped, preferably by sintering. Thus the preferred resistive element comprises a matrix consisting essentially of organic polymer particles, preferably ultrahigh molecular weight polyethylene, which have been sintered together so that the particles have coalesced without completely losing their identity, and a particulate conductive filler, preferably carbon black, which is dispersed in the matrix but which is present substantially only at or near the boundaries of the coalesced particles. The preferred compositions have a resistivity of less than 1000 ohm-cm, preferably less than 100 ohm-cm, particularly less than 10 ohm-cm, e.g. from 0.5 to 10 ohm-cm. Examples of such compositions and devices comprising them may be found in U.S. Pat. Nos. 4,775,501 (Rosenzweig et al), 4,853,165 (Rosenzweig et al), International Application Nos. PTC/US88/00592 (McMills et al, filed Feb. 24, 1988, published as No. W088/06517 on Sep. 7, 1988) and PCT/US89/02738 (McMills et al, filed Jun. 22, 1989), and copending, commonly assigned application Ser. Nos. 07/194,780 (Rosenzweig et al, filed May 17, 1988 now U.S. Pat. No. 4,921,648, 07/250,024 (McMills et al, filed Sep. 26, 1988), 07/299,915 (McMills et al, filed Oct. 21, 1988), 07/394,288 (McMills, filed Aug. 15, 1989) now U.S. Pat. No. 4,938,820, 07/407,595 (McMills et al, filed Sep. 15, 1989) 07/428,487 (McMills et al, filed Oct. 31, 1989), now abandoned in favor of a continuation application, Ser. No. 07/547,300 (filed Oct. 12, 1990), 07/435,854 (Rosenzweig et al, filed Nov. 13, , 07/462,893 (Soni et al, filed Jan. 3, 1990), the disclosures of which are incorporated herein by reference.

The compositions used in this invention generally exhibit ZTC (zero temperature coefficient of resistance) behavior, i.e. they have a resistivity which changes by less than 6 times, preferably by less than 2 times, in any 30° C. temperature range within the operating range of the heater. For some applications, however, compositions which exhibit PTC (positive temperature coefficient of resistance) behavior may be used. In this specification, the term "PTC" is used to mean a material or device which has an $R_{14}$ value of at least 2.5 and/or an $R_{100}$ value of at least 10, and particularly preferred that it should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range.

The resistive element can be configured into a tape by any suitable means, although for preferred compositions comprising ultrahigh molecular weight polyethylene, skiving from a ram-extruded rod or tube is preferred. The tape may be crosslinked by chemical means or by irradiation. In this specification the term "tape" is used to mean any configuration of the resistive element in which the resistive element is in the form of a laminar element having a relatively wide and thin cross-section. There is a sufficiently high ratio of external surface area of the tape from which heat is dissipated to polymer volume in the heat-producing region to enable it to withstand a minimum of about 50 watts/cm$^3$ and/or about 7 watts/in$^2$ when the tape is in contact with a solid substrate. Although the tape normally has a rectangular cross-section, other cross-sectional shapes, e.g. oval or dog-bone, may be appropriate for various applications, as long as the resistive element has a ratio of width to thickness of at least 8, preferably at least 20, particularly at least 50, especially at least 100, e.g. 100 to 160. The ratio of the external surface area to the polymer volume is at least 20 inch$^{-1}$, preferably at least 40 inch$^{-1}$, Particularly at least 40 to 100 inch$^{-1}$, e.g. 55 to 75 inch$^{-1}$. In calculating this ratio, the surface area of both sides of the tape is used. The useful tape has a thickness of 0.005 to 0.150 inch (0.013 to 0.381 cm), preferably 0.005 to 0.075 inch (0.013 to 0.191 cm), particularly 0.005 to 0.050 inch (0.013 to 0.127 cm), e.g. about 0.010 to 0.030 inch (0.025 to 0.076 cm), a thickness which allows the tape to exhibit excellent toughness and flexibility. The width of the tape, as measured between the electrodes, is 0.5 to 2 inches (1.27 to 5.08 cm), preferably 0.75 to 1.75 inches (1.91 to 4.44 cm), particularly 1.0 to 1.5 inches (2.54 to 3.81 cm). Generally the tape is of uniform width and thickness, but can be of non-uniform width and/or non-uniform thickness, e.g. corrugated, ribbed, or grooved.

The heating element also comprises elongate electrodes which are secured to opposite edge portions, i.e. margins, of the resistive element and which can be connected to a source of electrical power to cause current to pass through the resistive element. While most heating elements are designed with two electrodes, there may be any number depending on the power source and electrical configuration. The electrodes may be partially or completely embedded in the conductive polymer element, or they may be attached to one surface or opposite surfaces of the resistive element, preferably on the same surface. In this embodiment, substantially all of the current flows in the plane of the laminar element and little or none of the heated portion of the laminar element is covered by the electrodes so that heat is generated in the section between the electrodes. The electrodes may comprise any convenient material, e.g. a flexible wire, a conductive ink, a metal foil such as electrodeposited copper or nickel, or a combination of these, e.g. a metal foil attached to the resistive element by means of a conductive silver ink. In a preferred embodiment, the electrodes comprise a metal layer, e.g. a metal braid or apertured metal foil, surrounding a core of adhesive, particularly conductive adhesive. If the electrode is heated, e.g. from an external source or through $I^2R$ heating, while in contact with the conductive polymer resistive element, the adhesive will melt and flow through the interstices of the metal layer to contact and bond to the resistive element. In some cases, where excellent flexibility or very low contact resistance is required, it is desirable to attach the adhesive to an intermediate layer such as a layer of silver paint, a conductive epoxy, or a resilient, deformable conductive material. Electrical leads may be attached to each electrode to connect them to a power source. In an automobile or other vehicle, the power source is commonly the battery, although another power supply may be used.

The heating element may optionally be covered with an insulating jacket layer in order to provide electrical insulation and environmental protection.

At least any surfaces of the support member which are contacted by the electrodes or heating element are composed of electrically insulating material. Preferably the support member is in the form of a flat sheet of electrically insulating material. Suitable materials include woven or nonwoven fabrics, e.g. felt, fiberglass, or nylon cloth, polymeric sheets, e.g. foam or polymer-impregnated fabrics, and cardboard or other reinforced paper. If the support member comprises a polymer it is preferred that the melting point of the polymer be greater than the temperature reached during normal operation of the heating element. The support member may be of any desired shape depending on the application and frequently it is preferred that the shape conform to the area to be heated. A suitable support member may have any thickness, although for flexibility, a thickness of less than about 0.500 inch (1.27 cm), preferably less than 0.250 inch (0.635 cm), particularly less than 0.100 inch (0.254 cm), e.g. 0.020 to 0.070 inch (0.051 to 0.178 cm) is preferred. The heating element is mounted on, wrapped around, or otherwise in contact with the support member. In a preferred embodiment, the tape is wrapped around the support member, i.e. laid out in a folded zigzag pattern with the support member separating the folds of the tape. In this design, the pitch of the tape, i.e. the distance between every two adjacent folds, is dependent on the thickness, width, and flexibility of the tape, as well as the desired power density. It has been found, for example, for a tape with a width of one inch, a pitch of 5 to 6 inches (12.7 to 15.2 cm) is suitable for a support member with dimensions of approximately 6 by 10 inches (15.2×25.4 cm). The pitch would normally be greater for a tape with less flexibility. A balance of useful heat output and flexibility is achieved in many applications when the area of coverage on the support member by the heating tape is about 50 to 75%. For optimum heat transfer, the tape is positioned on the support member with the electrodes facing away from the support member. This is particularly important when there is no insulating jacket on the tape in order to prevent electrical contact of the wires at any cross-over points of the heater, e.g. at the edges of the support member. The tape may be attached to the support member by any suitable means, e.g. stitched, stapled, or glued. For ease of fabrication a spray-on adhesive may be preferred. If metallic staples are used, it is necessary to avoid disturbing the electrical connections and avoid shorting to the electrodes. The flexible heater may be covered with an insulating jacket. It is preferred that the jacket, as well as the support member, be permeable to moisture, in order to allow any moisture, e.g. perspiration, to pass through the seat.

A plurality of individual flexible heaters can be attached to or sandwiched between a substrate or substrates if more than one distinct area must be heated or if the size of one flexible heater is insufficient to heat the entire area. When the heater is designed to heat people sitting in a seat, individual flexible heaters can be positioned only in those areas likely to be in contact with the person, thus reducing power requirements for the heater. Like the support member, the substrate may be in the form of a sheet. The flexible heater can be glued, stapled, sewn, or otherwise attached, to the substrate. The individual flexible heaters can then be electrically connected by soldering, crimping, or other attachment methods, or else can be individually powered. It may be desirable to supply separate power to each heater if, for example, one section of the heater must be constantly heated, but other sections require heat only intermittently.

As an alternative to being wrapped around a support member, the heating element may be at least partially embedded in a resilient polymeric foam. If, for example, the heating element is positioned in a desired configuration in a mold, a foamable polymeric composition could be poured into the mold. Upon curing, the heating element would be correctly fixed and the shaped, molded article could be incorporated directly into a seat or other element to be heated.

In a particularly preferred form the flexible heater is part of an upholstered seat for use, for example, in an automobile, boat, plane, snowmobile, or other vehicle. The seat comprises a back portion and a seat portion, the back portion constructed of a resilient back member which is covered by a back cover, and the seat portion constructed of a resilient seat member which is covered by a seat cover. In general, the back cover and the seat cover are the sections in contact with the passenger or person sitting. They may be made of leather, vinyl, cloth fabric, or some combination of these. The flexible heater may be positioned between the resilient seat member and the seat cover, between the resilient back member and the back cover, or both. For ease of construction, individual flexible heaters may be used in the back portion and the seat portion, but one flexible heater alone may be suitable for both portions. For many automotive applications, sufficient passenger comfort is provided by positioning a flexible heater in the back portion alone. Under these circumstances, it is preferred that the total surface area of the resistive element is 50 to 100 inch$^2$ (323 to 645 cm$^2$). In an automobile seat, the power source for the flexible heater is usually the car battery, and the heater is normally connected by a switch to an electrical lead connected to the battery. For the convenience of the passenger, a control unit which allows control of the amount of heat produced by the flexible heater is generally mounted next to the seat. A thermostat may also be used.

The precise width and thickness requirements of the heating element for a given application are determined by the available voltage and the desired power density of the tape. This power density, in turn, is dependent on the highest permissible temperature. Because the area of coverage on the support member by the heating tape (as determined by measuring both laminar surfaces of the support member) is about 15 to 40% for most applications, i.e. substantially greater than the coverage on conventional wire heaters, the heater can operate at a lower temperature, providing improved efficiency and safety.

The invention is illustrated by the drawing in which FIG. 1 shows, in perspective, a heating element 1 in the form of a tape. Two elongate electrodes 5,7 are positioned on one surface of the resistive element 3 near the edge. No electrically insulating jacket layer over the heating element is shown, but for some applications, this would be desirable.

Figure 2:
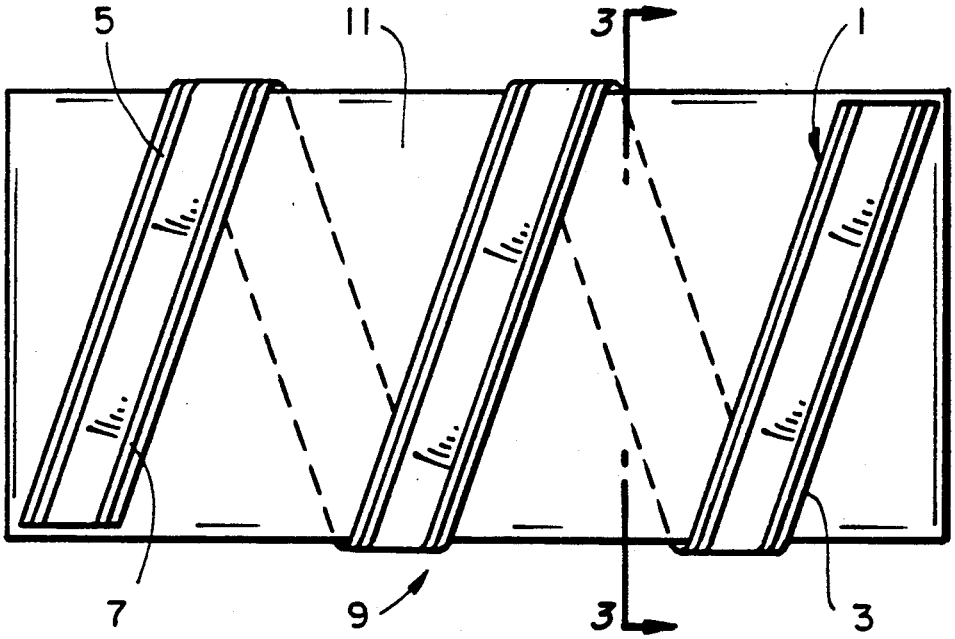
FIG. 2 is a plan view of a flexible heater of the invention.
Figure 3:
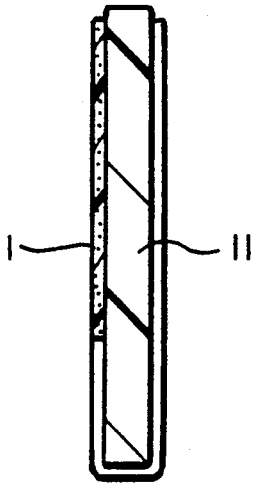
FIG. 3 is cross-sectional view along line 3—3 of FIG. 2.

FIG. 2 shows a plan view of a flexible heater 9 of the invention. In this embodiment, a heating element 1 is wrapped in a zigzag manner around a support member 11. The electrodes 5,7 of the heating element 1 are positioned away from the support member 11 in order to avoid electrically shorting out. FIG. 3 is a cross-sectional view along line 3—3 of FIG. 2 and shows sections of the zigzagged heating element 1 separated by the support member 11.

Figure 5:
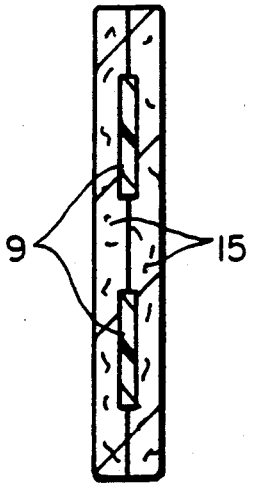
FIG. 5 is a cross-sectional view along line 5—5 of FIG. 4.
Figure 4:
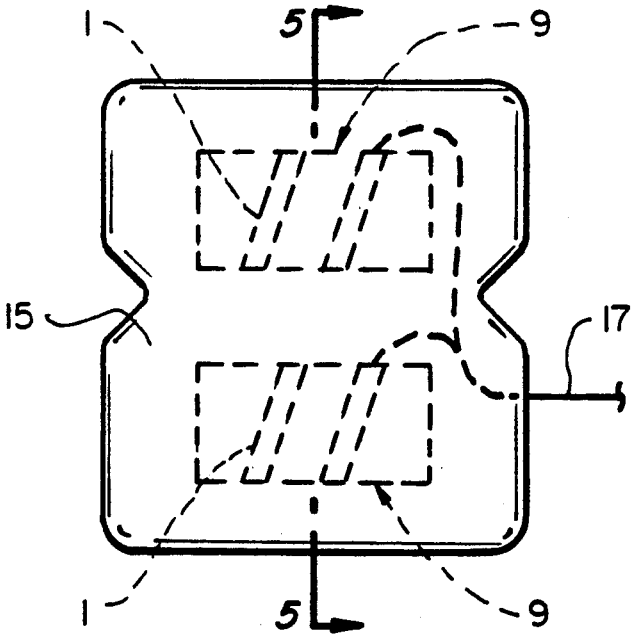
FIG. 4 is a plan view of one embodiment of a flexible heater of the invention.

FIG. 4 is a plan view of an embodiment of the invention comprising a flexible heater 13 which is suitable for heating a substrate, e.g. an automotive seat back or automotive seat base. In this design, two flexible heaters 9 are positioned between two sheets of a felt cover 15, i.e. a substrate. An electrical lead 17, suitable for connection to a source of electrical power, e.g. a battery, connects the two flexible heaters 9. FIG. 5 is a cross-sectional view along line 5—5 of FIG. 4 and shows the two flexible heaters 9 sandwiched between the felt cover sheets 15.

Figure 6:
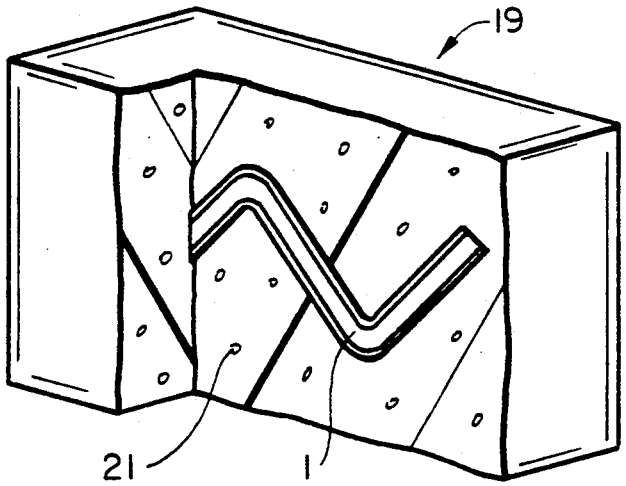
FIG. 6 is a perspective view, partially cutout, showing a shaped article of the invention.

FIG. 6 is a partially cut-away perspective view of a shaped article 19 of the invention. In this embodiment, the heating element 1 is embedded in a resilient polymeric foam 21.

Figure 7:
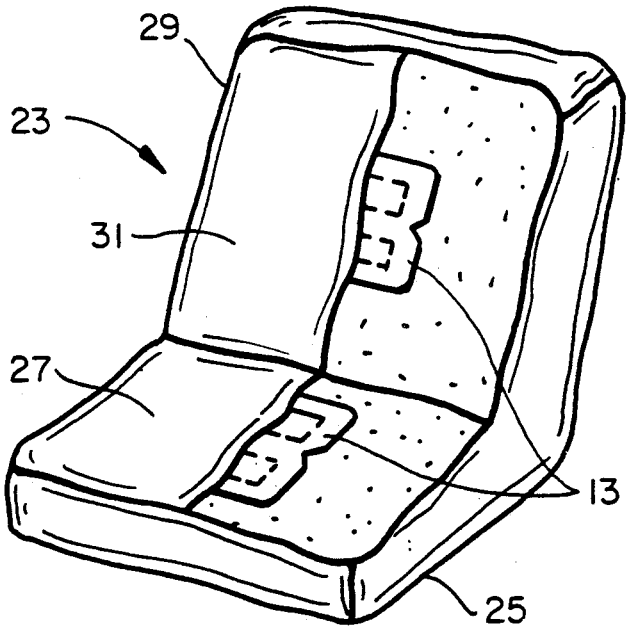
FIG. 7 is a perspective view, partially cutout, showing an upholstered seat of the invention.

FIG. 7 is a partially cut-away perspective view of an upholstered seat 23 of the invention. In this embodiment, two flexible heaters 13 are positioned to heat the seat, one on the base of the seat between the resilient seat member 25 and the seat cover 27, and one on the back of the seat between the resilient back member 29 and the back cover 31.

The invention is illustrated by the following example.

EXAMPLE

A conductive polymer composition was prepared by dry-blending in a high speed blender 95 parts by volume of ultra high molecular weight polyethylene powder, UHMWPE (Hostalen TM GUR-413, available form American Hoechst), having a molecular weight of about 4.0 million and an average particle size of about 0.1 mm, and 5 parts by volume of carbon black (Ketjenblack TM EC 300 DJ, available from Akzo Chemie). The mixture was extruded through a ram extruder heated to 200 to 225° C. at a rate of 5 feet/hour (1.52 m/hour) and a pressure of 3000 psi (2.07 MPa) to produce a sintered tube with an outer diameter of 8 inches (20.3 cm) and an inner diameter of 5.25 inches (13.3 cm). After cutting into 6 inch (15.2 cm) lengths, the tube was skived to produce a 0.010 inch by 6.0 inch (0.025 by 15.2 cm) element. This element was slit into four equal strips, each with a width of 1.5 inches (3.81 cm).

A conductive adhesive composition was prepared by mixing 89.5% by weight acrylic grafted polyolefin resin (Polybond TM 1016, available from Polymer Industries), 9.5% by weight carbon black (Ketjenblack TM EC 600, available from Akzo Chemie), and 1% antioxidant in a Banbury TM mixer. The mixture was pelletized and the pellets were then extruded to produce a solid rod with a diameter of 0.025 inch (0.064 cm). Electrodes were prepared by flattening 30 AWG silver-coated copper wire to give a cross-section 0.003 by 0.013 inch (0.008 by 0.033 cm), and then braiding twelve flattened wires around the conductive adhesive core.

A laminar heating element as shown in FIG. 1 was prepared by attaching two electrodes to the surface of a conductive polymer strip. The electrodes were positioned 1 inch (2.5 cm) apart on the surface of the conductive polymer strip and were pressed against the strip while passing a current of 25A per electrode through each electrode. As the electrodes heated, the adhesive melted and swelled through the interstices of the braided wires, thus attaching them to the polymer strip.

A heater cell was prepared by attaching a 20 inch-(50.8 cm-) long strip of heating element to a piece of felt measuring approximately $0.030\times6\times10$ inches ($0.076\times15.2\times25.4$ cm) by means of a pressure sensitive adhesive. The heating element was positioned as is shown in Fioure 2, by folding the heating element in a zigzag pattern with a pitch of about 6 inches (15.2 cm) over the edge of the shorter end of the felt. The side of the heater with the electrodes was positioned away from the felt. The heating element covered approximately 35% of the total area of the heater cell. The electrodes of a first heating cell were soldered to the electrodes of a second heating cell and the two heating cells were then sandwiched between and attached with a pressure sensitive adhesive to two pieces of felt cut as shown in FIG. 4. The resulting heater had dimensions of approximately $0.080\times14.5\times21.5$ inches ($0.203\times36.8\times54.6$ cm). An electrical lead was soldered to the electrodes of the first heating cell to provide electrical connection to a power source. When powered at 12 volts, the heater supplied about 24 watts of power.

Although the specific embodiments disclosed in this specification have been directed to automobile or vehicle seats, it is to be understood that heaters of the invention can be used to heat any type of surface, e.g. home or office furniture.

What is claimed is:

1. A flexible heater which comprises (1) a support member which is in the form of a flat sheet; and (2) a heating element which is in the form of a tape, which has a ratio of external surface area to polymer volume of at least 20 $inch^{-1}$, which is wrapped around the support member, and which comprises (a) a resistive element which is composed of a conductive polymer which comprises (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

2. A heater according to claim 1 wherein the conductive filler is carbon black.

3. A heater according to claim 2 wherein the polyethylene has a molecular weight of 4 to 6 million.

4. A heater according to claim 3 wherein the conductive polymer has a resistivity of less than 100 ohm-cm.

5. A heater according to claim 2 wherein the resistive element has a ratio of width to thickness of at least 20.

6. A heater according to claim 5 wherein said ratio is 50 to 200.

7. A heater according to claim 6 wherein the resistive element is 0.005 to 0.05 inch thick and 1.0 to 1.5 inch wide.

8. A heater according to claim 1 wherein the ratio of the total surface area of the heating element to the volume of the tape is 40 to 100 $inch^{-1}$.

9. A shaped article which comprises (1) a resilient foam of a polymeric material, and (2) at least partially embedded in the foam, a heating element which is in the form of a tape which has a ratio of external surface area to polymer volume of at least 20 $inch^{-1}$ and which comprises (a) a resistive element which is composed of (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

10. An upholstered seat which comprises a resilient seat member which is covered by a seat cover, a resilient back member which is covered by a back cover, and a flexible heater which lies between the resilient back member and the back cover, or between the resilient seat member and the seat cover, or both, the flexible heater comprising (1) a support member which is in the form of a flat sheet; and (2) a heating element which is in the form of a tape which has a ratio of external surface area to polymer volume of at least 20 $inch^{-1}$, which is wrapped around the support member, and which comprises (a) a resistive element which is composed of (i) particles of ultrahigh molecular weight polyethylene having a molecular weight of at least 3 million, which particles have been sintered without completely losing their identity, and (ii) a particulate conductive filler which is present substantially only at or near the boundaries of the coalesced particles; and (b) elongate electrodes which are secured to opposite margins of the resistive element and which can be connected to a source of electrical power to cause current to pass through the resistive element.

11. A seat according to claim 10 wherein the heater lies only between the resilient back member and the back cover.

12. A seat according to claim 11 wherein the total surface area of the resistive element is 50 to 100 $inch^2$.

13. A seat according to claim 10 wherein the back cover and the seat cover are made of leather.

14. A seat according to claim 10 which is in a wheeled vehicle and wherein the heater is switchably connected to the battery of the vehicle.

* * * * *